United States Patent [19]

Poll

[11] 4,350,103

[45] Sep. 21, 1982

[54] METHOD AND APPARATUS FOR THE COMBUSTION OF SOLID FUEL

[75] Inventor: Ian Poll, Amsterdam, Netherlands

[73] Assignee: Shell Oil Company, Houston, Tex.

[21] Appl. No.: 191,312

[22] Filed: Sep. 26, 1980

[30] Foreign Application Priority Data

Oct. 2, 1979 [GB] United Kingdom ..... 7934174

[51] Int. Cl.[3] ..... F23D 1/02

[52] U.S. Cl. ..... 110/264; 110/347; 239/402

[58] Field of Search ..... 110/263, 264, 265, 347; 431/182, 183, 184, 185; 239/403, 404, 405, 402

[56] References Cited

U.S. PATENT DOCUMENTS 1,290,607 1/1919 Lovekin ..... 431/183
1,860,987 5/1932 Braine et al. ..... 431/183
1,910,735 5/1933 Zikesch ..... 239/402 X
4,147,116 4/1979 Graybill ..... 110/347 X

FOREIGN PATENT DOCUMENTS 688915 3/1953 United Kingdom .
759757 10/1956 United Kingdom .

*Primary Examiner*—Edward G. Favors

[57] ABSTRACT

A partial combustion process for a particulate solid fuel and a burner for carrying out such a process is disclosed wherein the particulate fuel is injected into a premix chamber along with primary gas streams to support combustion and secondary gas streams to form a shroud of gas around the fuel as the mixture of fuel and gas leaves the pre-mix zone through a converging-diverging nozzle to enter the combustion zone.

9 Claims, 1 Drawing Figure

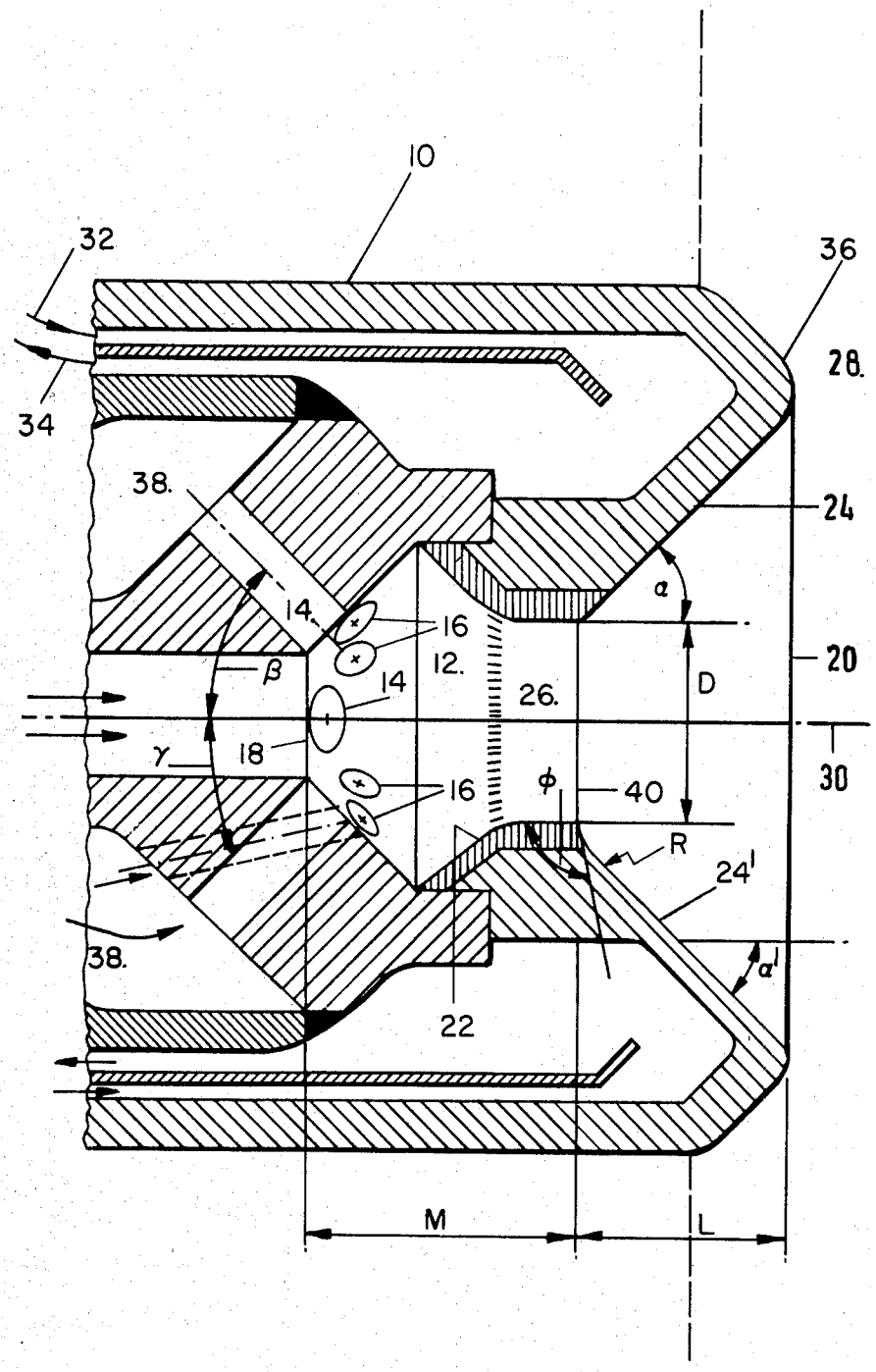
10
32
36
28
34
38.
24
α
14
16
12.
20
β
14
26.
D
γ
18
30
16
φ
40
R
24'
38.
α'
22
M
L

METHOD AND APPARATUS FOR THE COMBUSTION OF SOLID FUEL

TECHNICAL FIELD OF THE INVENTION

This invention relates to a process and apparatus for the preparation and/or combustion of solid particulate fuel.

BACKGROUND OF THE INVENTION

The efficient combustion of particulate fuels presents rather difficult problems that are different from those associated with liquid fuel combustion. Apart from pure particulate fuel handling difficulties, inefficient combustion is a serious problem due to variable particulate size and the fact that heat input to a solid fuel must be much higher than to a liquid fuel to sustain combustion. As a result, an efficient particulate fuel burner has not been available which will operate with a short, stable flame.

SUMMARY OF THE INVENTION

An object of the present invention is to provide a process and apparatus for the preparation for and efficient partial combustion of a solid fuel in particulate form.

In accordance with the invention, the process comprises injecting into a pre-mix zone a transfer fluid carrying the particulate fuel in a stream along a central flow axis to form a central stream which encounters a plurality of primary streams of oxygen or oxygen-containing gas. These primary streams impinge on the central stream at an angle of from about 30° to about 60° relative to the axis of flow of the central stream. It is important that the velocity of the primary oxygen containing streams be in excess of the velocity of the fuel stream so that the primary streams will penetrate the fuel stream. A plurality of the secondary oxygen-containing gas streams are also introduced into the pre-mix zone in the vicinity of the primary streams and at a velocity in excess of that of the fuel to form a shroud of gas around the central stream of fuel, as the mixture of fuel and oxygen or oxygen-containing gas leaves or flows from the pre-mix zone through a converging-diverging nozzle into the combustion zone.

The burner forms a pre-mix chamber having primary and secondary gas inlets situated around a central fuel inlet port which is disposed along the same central axis as the outlet formed by a converging-diverging nozzle. The primary gas inlets are directed radially inward at an angle of from about 30° to about 60° to the central axis and the secondary inlets are arranged so that in operation they form a shroud of gas around particulate fuel leaving the discharge nozzle.

In operation, combustion does not occur in the pre-mix zone. The residence time of the particulate fuel in the pre-mix zone is too short for sufficient heat to be transferred to the fuel to enable release of the more volatile components that is necessary for combustion to commence. The velocity and distribution of the fuel particles must therefore be controlled to prevent any premature combustion in the pre-mix chamber. The converging-diverging nozzle is also designed as an effective screen against radiation in order to supplement that provided by the dense cloud of fuel particles leaving the nozzle.

On leaving the nozzle the outer shroud of gas cmes into contact with hot combustion products which also contain some unburned matter or gases. These unburned products burn in contact with the gas shroud which burns inwardly into the cloud of particles. Since the velocity of the gas shroud is also controlled to be greater than that of the particles, the initial combustion front of the gas shroud causes the particles to heat up very rapidly. The resulting volatile components given off by the shroud and fuel particle front enable combustion of the solid fuel to begin. Once started, the combustion is rapid and self propagating due to the ready availability of the injected oxygen at the center of the fuel particle stream. Consequently, combustion flame length is short and the combustion efficient and stable.

In the case of partial combustion of coal for gasification, the combined stream of particulate coal and oxygen-containing gas enters directly into a partial oxidation reactor upon leaving the burner. Once in the reactor the shroud of oxygen rich gas comes into contact with hot reactor gases which start to burn. The resulting burning gases are deflected radially inwardly into contact with the fuel particles. This provokes rapid heat transfer resulting in stable combustion of the coal particles and producing a short, hot flame which reduces the reactor volume necessary for the desired gasification to occur.

The burner also makes better use of the available oxygen by reducing the proportion of oxygen which is lost by promoting complete combustion of the solid fuel or combustion with the reactor gas. Due to slip between the fuel particles and the gas for combustion it is not necessary that a high degree of swirl be imparted to the gas or to the fuel. "Swirl" is defined as the non-dimensional ratio at the burner exit of the axial flux of the tangential momentum to the axial flux of the axial momentum times the radius at the exit of the burner. In the present invention the swirl is preferably between 0 and 1.1.

The secondary inlet or inlets are preferably situated outside the primary inlets and are at an angle of between 0° to 30° to the central axis in order to form a shroud of gas around the fuel particles in the central stream. While it is simplest to form the plurality of primary and secondary inlets by drilling holes of the desired dimensions, an effective alternative burner utilizes an annular slit, or series of slits forming an annulus, in the wall of the pre-mix chamber. The secondary inlets may be also arranged to impart a rotation to the secondary supply of gas, for example by forming them at a skew to the axis in the case of individual ports, or by fitting swirl vanes in the annular slit or slits.

The wall of the pre-mix chamber diverges outwardly from about 30° to about 60° with respect to the central axis from the central fuel inlet, in order to facilitate the siting of the gas inlets in the wall. In its most convenient form the wall is conical, but it may also be in the form of any concave or convex surface of revolution, or polygon, either continuous or stepped, according to normal design considerations for flame stabilization.

The diverging section of the outlet nozzle will also normally form the mouth of the burner, which may be angled from about 30° to about 60° relative to the central axis and from about 0.5D to about 2D in length, where D is the diameter of the throat or narrowest section of the nozzle. The burner mouth may also be formed in such a way as to induce greater swirl. One particularly suitable form for the burner mouth is the shape of a tulip with a sharp angle formed between the nozzle throat and the beginning of the burner mouth having a smooth transition to a substantially conical exit. The transition may have a radius of from about 0.25D to about 0.6D and may be between about 70° and about 120°.

To avoid the risk of pre-combustion occurring inside the pre-mix chamber the length of the chamber measured from the fuel inlet to the start of burner mouth should not be more than about 3.0D. Its minimum length is governed by the physical constraint of space needed to provide good fuel distribution in the pre-mix chamber. In practice, the length of the pre-mix chamber will not be less than about 1.0D.

For satisfactory operation of the burner in accordance with the invention the various inlet velocities and pressures should be controlled so that the swirl is maintained between about 0 and about 1.1. This will generally provide an optimum average stream velocity at the burner mouth of about 70 meters/second though the necessary conditions may well be met at velocities over the range of about 35 to about 100 meters/second.

In most cases the fuel will be delivered to the burner using a transport gas which is inert to the fuel particles. This may be either recycled reactor gas, carbon dioxide, nitrogen or steam, or a mixture of two or three of the above gases.

BRIEF DESCRIPTION OF THE DRAWING

The FIGURE is a side elevation view, in section of the particulate fuel burner of the present invention illustrating two different details of the diverging nozzle section above and below the central axis.

DESCRIPTION OF PREFERRED EMBODIMENT

Reference should now be made to the FIGURE for further description of the invention. Although the burner of the present invention is normally symmetrical in construction, two different forms of diverging nozzles have been illustrated for the sake of convenience, one being above and the other form below the central axis.

The burner 10 of the present invention forms a pre-mix chamber 12 having primary 14 and secondary 16 combustion gas inlets situated around a central fuel inlet port 18. A central outlet 20 to the pre-mix chamber is provided on the opposite side of the pre-mix chamber from the central fuel inlet port and is disposed co-axially with it. The central outlet is in the form of a converging-diverging nozzle having a converging section 22 and a diverging section 24 separated by a nozzle throat 26 of diameter D.

The diverging section 24 of the nozzle, which also forms the mouth of the burner, controls the expansion of the gases and solids as they leave the burner and enter the reaction chamber situated at 28. The half-angle of the burner mouth or nozzle diverging section should be between about 30° and about 60° from the axis 30 of the burner depending upon the exit velocity and scale of the burner. The mouth shown in the upper half of the drawing has an angle $\alpha$ of 45°.

The mouth 24' shown in the lower half of the drawing is tulip-shaped and forms an angle $\phi$ with the throat of the burner. The mouth 24' has a smooth transition of radius R to a conical portion of half-angle $\alpha'$. In the burner drawn $\phi$ is 95° and R is 0.5D, while $\alpha$ is 45° as in the straight burner mouth 24 illustrated in the half of drawing above the central axis.

The length of the burner mouth is also important in preventing premature mixing with hot reactor gases and promoting turbulence in the gas-fuel mixture. Its maximum length L will be approximately three times the diameter of the throat while a minimum length L of at least half a diameter is necessary in order to obtain the necessary turbulence near the exit of the burner and to protect the pre-mix chamber from excessive heat transfer from the flame and reactor gases.

The nose 36 of the burner, which also forms the mouth 24 is subjected to a considerable heat flux which requires cooling for protection. Such protection is provided by enclosed coolant flow as indicated by arrows 32 and 34.

An important aspect of the burner resides in the disposition of the combustion gas inlets 14 and 16. The inlets are connected with a gas supply, preferably of oxygen or an oxygen-containing gas mixture, via annular ducts 38 in the usual manner.

The primary gas inlets are inclined at 45° to the central longitudinal axis 30 as is indicated by the angle $\beta$ in FIG. 1. One purpose of these primary flow inlets is to break up the central stream of transported fuel particles emerging from the fuel port 18 and the velocity of the primary gas must be such as to penetrate the central stream but not to re-emerge on the opposite side of it. It is important that the primary gas remains within the central particle stream, though still moving at a higher velocity. In the burner shown, there are 4 primary inlets 14 which are situated adjacent to and radially outwardly of the fuel inlet port 18. The value of 45° has been found to be the optimum for the angle $\beta$ in the embodiment shown.

The secondary gas inlets 16 are inclined at approximately 17° to the axis 30 as indicated by $\gamma$ in the drawing. The angle $\gamma$ and the disposition of the inlets 16, of which 8 are provided is important. They are situated further radially outwardly from the fuel port 18 than the primary inlets 14 and are arranged so that in operation they substantially provide or form a shroud of gas around the fuel particles in the nozzle throat 26. As explained above the shroud not only performs the initiation of the combustion of the fuel particles but also reduces mechanical abrasion on the nozzle throat 26. As shown, the secondary inlets are aligned with the inner side of the throat 26 and converge on the central axis 30 rather than being disposed askew to that axis.

The pre-mix chamber 12 extends from the fuel inlet port 18 to the end of the throat 26, indicated by reference 40. Its length, indicated by reference character M, should be between about one and about three times nozzle throat diameter in order to provide sufficient mixing time while not being so long that the fuel particles can be accelerated to such a point by the faster moving gas that the all important flow slip between the two phases is lost. Nor should the fuel become so hot that the volatile components begin to be released, which could result in pre-combustion. In the burner, M is approximately 1.4 times nozzle throat diameter (1.4D).

The burner illustrated is preferably designed for ground coal whose dimensions are consistant with normal power station milling, e.g., Sauter mean diameter of approximately 50 to 75 microns. The coal particles will normally be injected through central opening 18 in combination with a small quantity of transport gas which may be steam, carbon dioxide, nitrogen or reactor gas for the production of hydrogen or carbon monoxide/hydrogen mixtures by partial oxidation. The latter fluid has the advantage that it avoids dilution of the reactor products with an inert transport gas.

As illustrated the burner is designed to operate at a reactor pressure typically of about 10 to about 60 bar with a mean outlet velocity of 70 meters/second at full load. This permits the burner to operate at a turndown ratio of 2 at 35 meters/second. Slight overload may be obtained by increasing the velocity up to 100 meters/-second.

The foregoing disclosure and description of the invention process and apparatus are illustrative and explanatory thereof, and various changes in the size, shape and materials of the illustrated construction as well as in the details of the described process may be made without departing from the spirit of the invention.

I claim:

1. A process for the gasification of a solid particulate fuel by partial combustion, which comprises the steps of:

injecting into a pre-mix zone along a central flow axis a stream of transfer fluid having the particulate fuel disposed therein to form a central flow stream;

impinging a plurality of primary oxygen containing streams upon the central stream of transfer fluid having the particulate fuel disposed therein at an angle in the range of 30° to 60° relative to the central flow axis and having a velocity exceeding the velocity of the central stream; and injecting a plurality of secondary oxygen containing gas streams into the pre-mix zone at a velocity in excess of the fuel stream for forming a shroud around the central stream as the mixture of fuel and gas streams flow from the pre-mix zone through a converging-diverging nozzle having a throat section into a combustion zone.

2. The process of claim 1, wherein:

the primary oxygen containing stream is injected into the pre-mix zone at a relative mean velocity of about ten to about seventy meters per second greater than the mean velocity of the central fuel stream.

3. The process of claims 1 or 2, wherein:

the mean velocity of the gas and fuel streams through the nozzle section is about 35 to about 100 meters/-second.

4. The process of claims 1 or 2 wherein:

the gas and fuel streams are directed through the nozzle section to achieve a swirl number of about 0 to about 1.1.

5. The process of claims 1 or 2 wherein:

the primary oxygen containing gas streams are impinged of the central flow stream to achieve a mean axial velocity at the exit of the nozzle of about 1.5 to about 10 times the mean axial velocity of the central flow stream.

6. The process of claims 1 or 2 wherein:

the secondary oxygen containing gas streams are injected to achieve a mean axial velocity at the exit of the nozzle of about 1.5 to about 10 times the mean axial velocity of the central flow stream.

7. A burner apparatus for the gasification of a solid particulate fuel by partial combustion, including:

a burner having a pre-mix chamber forming a central longitudinal axis;

a central inlet port formed on said central longitudinal axis for enabling injection of a stream of transfer fluid having the particulate fuel disposed therein into said pre-mix chamber;

a converging-diverging nozzle having a throat section disposed on said central longitudinal axis to provide an outlet for said pre-mix chamber for enabling central flow in said pre-mix chamber along said central axis, the axial length of the diverging part of said nozzle being about 0.5D to about 2D, where D is the diameter of the narrowest section of the throat section;

a plurality of primary gas inlets disposed about said central inlet port, said plurality of primary gas inlets directed radially inwardly at an angle of between 30° to 60° relative to the central longitudinal axis; and a plurality of secondary gas inlets about said central inlet port, said plurality of secondary gas inlets directed radially inwardly to form a uniform shroud of gas around the central stream.

8. The burner of claim 7, wherein:

the axial length of the pre-mix chamber between the fuel inlet and the diverging part of the nozzle is about D to about 3D, where D is the diameter of the narrowest section of the nozzle.

9. The burner of claim 7, wherein:

the surface of the diverging portion of the nozzle forms an initial angle with the throat section relative to the central axis of 95° to form a tulip shape.

* * * * *